US005373612A

United States Patent [19]

Kopetzky

[11] Patent Number: 5,373,612

[45] Date of Patent: Dec. 20, 1994

[54] BUCKLE DEVICE IN SEAT BELT APPARATUS

[75] Inventor: Robert Kopetzky, Mutlangen, Germany

[73] Assignee: Takata Corporation, Tokyo, Japan

[21] Appl. No.: 19,316

[22] Filed: Feb. 18, 1993

[30] Foreign Application Priority Data

Feb. 19, 1992 [JP] Japan ..... 4-031974

[51] Int. Cl.[5] ..... A44B 11/00

[52] U.S. Cl. ..... 24/637; 24/633

[58] Field of Search ..... 24/637, 636, 633, 634, 24/606, 602, 643, 646; 297/468, 483

[56] References Cited

U.S. PATENT DOCUMENTS

| | | | |
|---|---|---|---|
| 2,863,200 | 12/1958 | Miller et al. | 24/634 |
| 3,481,009 | 12/1969 | Preston et al. | 24/637 |
| 4,930,195 | 6/1990 | Haglund | 24/637 |
| 4,972,559 | 11/1990 | Haglund | 24/637 |
| 5,029,369 | 7/1991 | Oberhardt et al. | 24/633 |

FOREIGN PATENT DOCUMENTS

| | | | |
|---|---|---|---|
| 0384703 | 8/1990 | European Pat. Off. . | |
| 1038619 | 8/1966 | United Kingdom | 24/637 |
| 2173243 | 10/1986 | United Kingdom . | |
| 2227513 | 8/1990 | United Kingdom . | |
| 2249806 | 5/1992 | United Kingdom . | |

*Primary Examiner*—Victor N. Sakran
*Attorney, Agent, or Firm*—Varndell Legal Group

[57] ABSTRACT

To inhibit an actuating member from being moved to a release position, to make the manipulation feeling satisfactory, and to provide a compact and cheap buckle device.

[Arrangement] When a large downward acceleration acts upon a buckle device 10, an upward inertia force F1 acts upon the gravitational center G of an inertia member 15 which is therefore rotated about a second support boss 17 so that a movement inhibiting part 15*a* abuts against the side wall of a second projected part 12*b.* in this condition, when a large upward deceleration acts upon the buckle device 10, large downward inertia forces F2, F3 act upon the gravitation center of an actuating member 12 and the gravitational center G of the inertia member, and accordingly, the actuating member 12 and the inertia member 15 are moved downward. When the upper end of a first hole 15*c* abuts against a first support boss 16, the inertia member 15 is inhibited from further moving downward, and when a step part 12*c* abuts against the upper end the movement inhibiting part 15*a,* the actuating member 12 is inhibited from further moving downward, by means of the inertia member, thereby the actuating member 12 will not move to the release position.

11 Claims, 8 Drawing Sheets

BUCKLE DEVICE IN SEAT BELT APPARATUS

BACKGROUND OF THE INVENTION

The present invention relates to a seat belt apparatus which is incorporated in a seat in an automobile or other transportation means, so as to restrain the passenger in order to protect the same upon occurrence of abnormal condition such as collision between vehicles or the like, and in particular to a seat belt apparatus incorporating a pretensioner which pulls a buckle engaged with the tongue toward the vehicle body side so as to fasten the seat belt in order to inhibit the passenger from moving forward upon abrupt deceleration caused by occurrence of an abnormal condition such as collision between vehicles or the like.

At present, a seat belt apparatus is incorporated in a seat in an automobile or other transportation means in order to protect the passenger upon occurrence of an emergency condition such as collision between vehicles or the like. The seat belt apparatus of such a kind incorporates, in general, a tongue attached to the seat belt, and a buckle device to which the tongue is locked, and by engaging and disengaging between the tongue and the buckle device, the seat belt can be simply worn or taken off.

Further, in such a seat belt apparatus, the seat belt is wound on a wind-up reel in a retractor by a relatively weak force, and accordingly, the seat belt is freely pulled out normally so that no oppression is exerted to the passenger since the wind-up force of the retractor is relatively weak. Further, by locking the rotation of the wind-up reel in the pay-out direction of the seat belt upon abrupt deceleration of a vehicle caused by collision between vehicles or the like, the forward movement of the passenger is inhibited.

By the way, in a conventional seat belt apparatus, the seat belt is slightly paid off due to further fastening of the seat belt by wind-up upon locking the rotation of the wind-up reel in the case of abrupt deceleration. Further, since the seat belt is likely to be relatively loosely worn, the seat belt is normally slack, and further since it is pulled by the inertia force of the passenger, the seat belt is elongated by a slight degree. Due to such pay-out, slack and elongation of the seat Pelt, the passenger is moved forward upon deceleration, and accordingly, it is sometimes impossible to restrain the passenger.

Accordingly, seat belt apparatuses incorporating a pretensioner have been developed, in which the pretensioner is operated upon abrupt acceleration so as to pull the buckle device in order to fasten the seat belt, thereby it is possible to inhibit the passenger from being moved forward, in a more positive manner.

As the pretensioner, there has been developed a pretensioner such that reactive gas is generated upon deceleration, and a piston is operated by the gas thus generated to fasten the seat belt. The pretensioner actuated by the reactive gas can be formed in a relatively simple manner, and it can be rapidly respond upon necessity to rapidly fasten the seat belt.

Further, there is provided a pretensioner using a spring as a drive source for actuating the pretensioner.

However, in such a pretensioner, a large acceleration is at first produced in the pulling direction of the pretensioner since the buckle device is pulled abruptly by a predetermined degree upon operation, and a predetermined deceleration is produced after the movement of the buckle device by the predetermined degree. Accordingly, the actuating member which is adapted to release the engagement with the tongue provided to the buckle device is moved in the releasing direction by its inertia, and therefore, there is a risk of releasing the engagement with the tongue.

Accordingly, Japanese Laid-Open Patent Publication No. 3-208752 discloses a belt lock for a safety system in which during the operation of the pretensioner, when a large deceleration acts upon the buckle device during the operation of the pretensioner, tile engagement between the tongue and the latch member in tile buckle device is prevented from being released, by restraining the actuating member from moving in the releasing direction. This belt lock has a lever which is swingably supported at its intermediate part to the housing, and which is provided at one end with a compensating weight and is coupled at the other end, relatively rotatably to the actuating member so that when the actuating member tends to move in the releasing direction by an inertia upon occurrence of a large deceleration, a force in a direction opposite to the direction of the inertia force acting upon the actuating member is applied to the actuating member through the intermediary of the lever by the inertia force acting upon the compensating weight in order to restrain the actuating member from moving in the releasing direction.

Accordingly, the engagement between the tongue and the buckle device is prevented during the operation of the pretensioner.

However, with such a belt lock in the safety belt system, since the inertia force acting upon the compensating mass has to cope with the inertia force of the actuating member, the compensating mass should be made to be large. Accordingly, the weight of the belt lock becomes large. Further, although it is possible to decrease the compensating mass, the lever ratio should be made large in this case, and accordingly, the length of the lever on the compensating mass side has to be relatively large. Thus, the belt lock becomes large.

Further, in the case in which the compensating mass is increased or the length of the lever on the compensating side is increased, since the lever is coupled to the actuating member, this compensating mass should be swung upon normal releasing operation of the actuating member, and accordingly, a relatively large force is required, resulting in heavy manipulation touch and in unsatisfactory manipulation feeling.

Further, since the large compensating mass should be swung, not only the strengths of the support shaft for supporting the lever and the coupling part between the other end of the lever and the actuating member should be ensured up to certain degrees, but also the relative motion between the lever and support shaft and the relative motion between the other end of the lever and the actuating member should be made to be smooth. Accordingly, it is necessary to increase the degree of accuracy in process and assembly so that the cost thereof becomes high.

Further, since a force caused by the inertia force acting upon the compensating mass acts upon the actuating only in a direction opposite to the inertia force of the actuating member, a case such that the movement of the actuating member cannot be surely inhibited, sometimes occurs.

The present invention is devised in view of the above-mentioned problems, and accordingly, one object of the present invention is to provide buckle device in a seat belt apparatus which can surely inhibit the actuating member from moving in the releasing direction upon operation of the pretensioner, and which can be formed to be compact and cheap, and which can offer a satisfactory manipulation feeling.

SUMMARY OF THE INVENTION

In order to solve the above-mentioned problems, the invention stated in claim 1, incorporates at least actuating member normally held at an unrelease position and adapted to be moved to a release position during manipulation, for releasing the engagement between a tongue and a latch member, and which is abruptly pulled by a predetermined distance by a pretensioner upon abrupt deceleration of a vehicle such as collision between vehicles, and is characterized in that an inertia member is disposed movably between an allowable movement position where said actuating member is allowed to move to said release position and a movement inhibiting position where the actuating member is inhibited from moving to said release position, and further, the inertia member is normally held at said allowable movement position, and is set so as to be moved to said movement inhibiting position by its inertia force upon operation of said pretensioner.

Further, the invention stated in claim 2 is characterized in that said actuating member is stored in a housing while said inertia member is provided rotatably in said housing, and said inertia member further comprises a movement inhibiting part which is rotated to said movement inhibiting position so as to move to a position where it can engage with said actuating member when an inertia force acts in a direction opposite to a moving direction in which said actuating member is moved to said release position in association with the operation off said pretensioner, whereby when the inertia force acts upon said inertia member in the direction opposite to the moving direction of said actuating member in association with the operation of said pretensioner, said movement inhibiting member is set at the position where said movement inhibiting part can engage with said actuating member, and thereafter, when the inertia force acts upon said inertia member in the moving direction of said actuating member toward said release position, said actuating member is moved by the inertia force toward said release position so as to engage with said movement inhibiting part, thereby the movement of said actuating member toward said release position is inhibited.

Further, the invention stated in claim 3 is characterized in that said actuating member is stored in a housing while said inertia member is provided rotatably in said housing, and said inertia member further comprises a movement inhibiting part which is rotated to said movement inhibiting position so as to move to a position where it can engage with a stopper provided to said housing when an inertia force acts in a direction opposite to a moving direction in which said actuating member is moved to said release position in association with the operation of said pretensioner, whereby when the inertia force acts upon said inertia member in the direction opposite to the moving direction of said actuating member in association with the operation of said pretensioner, said movement inhibiting member is set at the position where said movement inhibiting part can engage with said stopper, and thereafter, when the inertia force acts upon said inertia member in the moving direction of said actuating member toward said release position, said actuating member is moved by the inertia force toward said release position so that said movement inhibiting member engages with said stopper, thereby the movement of said actuating member toward said release position is inhibited.

In the buckle device thus constructed in a seat belt apparatus, according to the present invention, since the inertia force of the inertia member acts at first in a direction opposite to the direction in which the actuating member moves to the release position, the inertia member is at first set to the movement inhibiting position by the inertia force. Further, since an inertia force acts upon the actuating member in the moving direction of the actuating member toward the release position, the actuating member tends to be moved to the release position by inertia force. However, the movement of the actuating member toward the release position is inhibited by the inertia member, and accordingly, it is not moved up to the release position. Thereby, it is possible to prevent the actuating member from moving to the release position so as to erroneously release the engagement between the tongue and the latch member in the buckle device when the buckle device is abruptly pulled in association with the operation of the pretensioner.

Figure 1B:
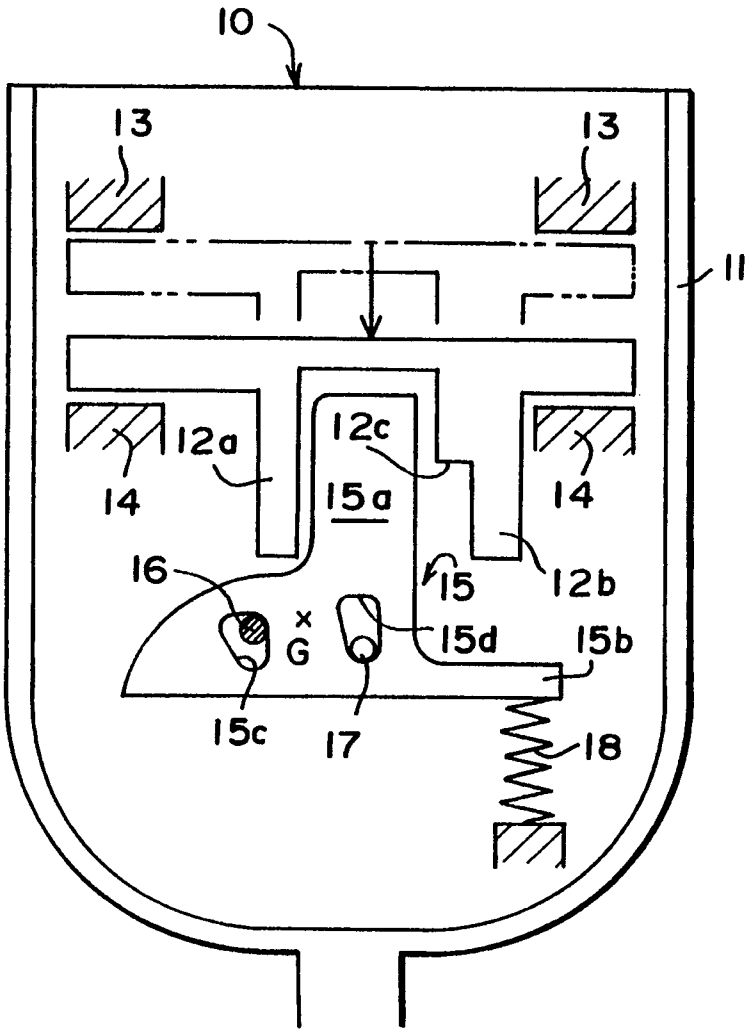
FIGS. 1(*a*) and 1(*b*) typically show one embodiment of a buckle device in a seat belt apparatus, according to the present invention, in which FIG. 1 (*a*) is a view illustrating a non-operating mode of an actuating member in a normal condition, and FIG. 1 (*b*) is a view illustrating the operating mode of the actuating member in the normal condition.

In the figure, the reference numeral 10 represents a buckle device, 11 a buckle housing, 12 an actuating member, 12*a* and 12*b* a first and a second projected parts, 12*c* a step part, 13 and 14 a first and a second stoppers, 15 an inertia member (control member), 15*a* a movement inhibiting part, 15*c* and 15*d* a first and a second holes, 16 and 17 a first and a second support bosses, 18, a compression spring, 19 a rotation inhibiting member, 19*a* and 19*b* a first and a second abutting surfaces, 20 a rotation inhibiting member, 20*a* teeth, 21 a stopper, 21*a* and 21*b* a first and a second fitting recess parts, 21*c* a bottom, 21*d* a side wall, and G the center of gravity of inertia member. In the drawings, "a" shows unrelease position, and "b" release position.

DETAILED DESCRIPTION OF THE PREFERRED EMBODIMENT

Next, explanation will be made on an embodiment of the present invention with reference to the drawings.

Figure 1A:
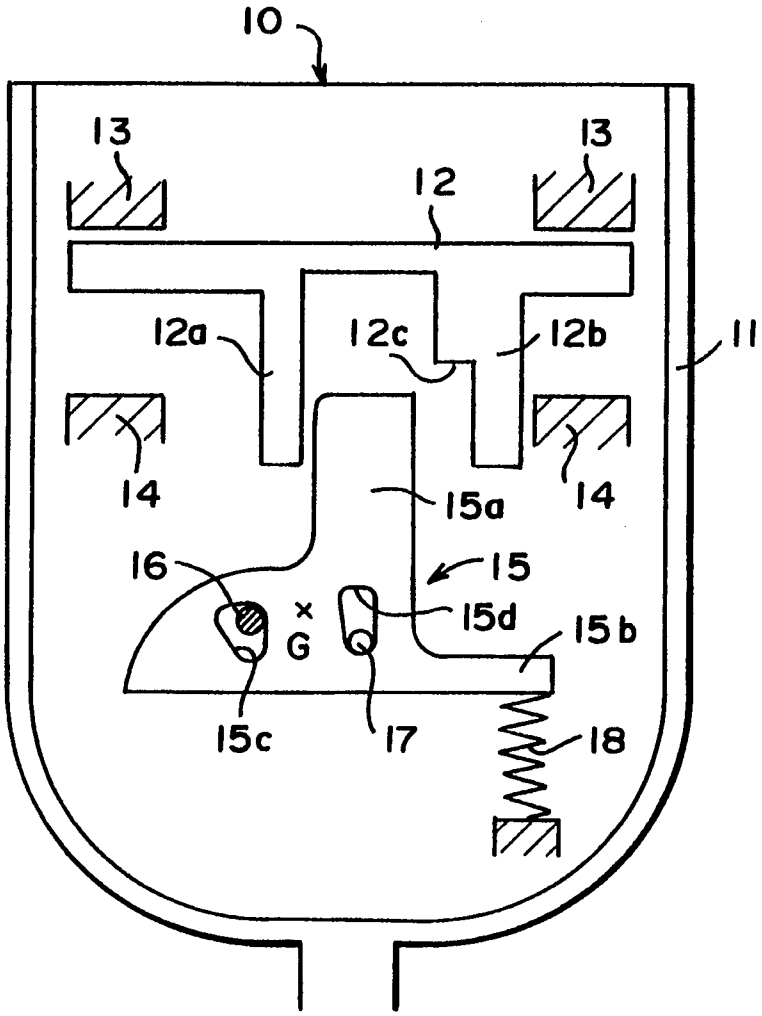
Figure 2B:
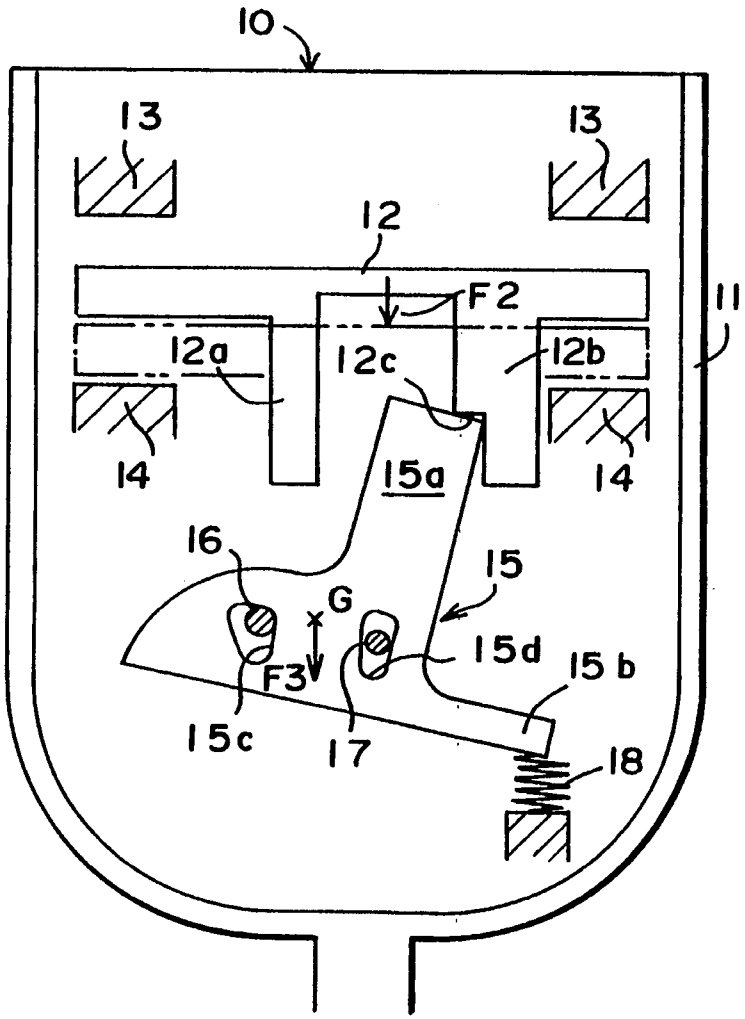
FIGS. 2(*a*) and 2(*b*) typically shows the above-mentioned embodiment in which FIG. 2 (*a*) is a view illustrating the operating mode of an inertia member when the actuating member is moved to a release position, and FIG. 2 (*b*) is a view illustrating the operating modes of the actuating member and the inertia member when an acceleration of a predetermined degree acts upon the actuating member in a direction opposite to the direction in which the actuating member is moved to the operating position.
Figure 2A:
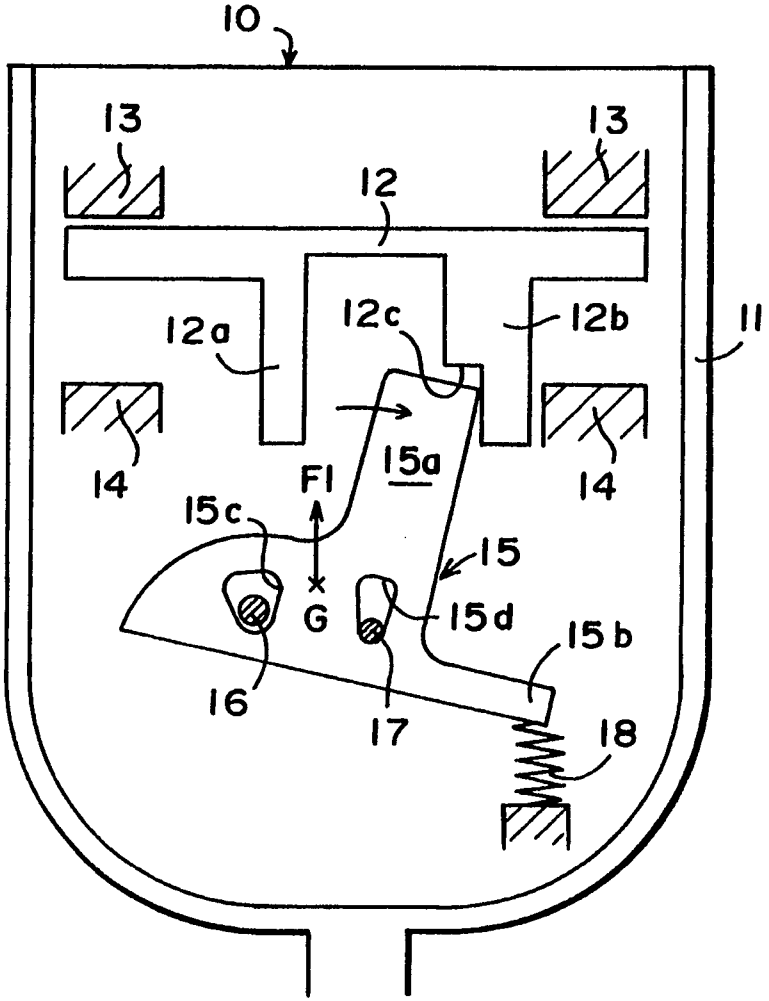

FIGS. 1 and 2 typically show an embodiment of a buckle device in a seat belt apparatus according to the present invention.

As shown in FIGS. 1 (*a*) and (*b*), in the buckle device 10 according to this embodiment, an actuating member 12 which is a part of a release mechanism for releasing the engagement between a latch member (which is not shown) and a tongue (which is not shown) for the buckle device 10 is disposed in a buckle housing 11. A pair of stoppers 13, 14 are arranged in the buckle housing 11, vertically with a predetermined space therebetween, the actuating member 12 being movable between the stoppers 13, 14.

Further, the actuating member 12 is urged always upward by means of an urging means (which is not shown) such as a spring or the like so that the actuating member 12 normally abuts against the upper stopper 13 as shown in FIG. 1 (*a*). The position where the actuating member 12 abuts against the stopper 13, is an unrelease position at which the actuating member 12 does not release the engagement between the latch member and the tongue. When the actuating member 12 is pushed downward, overcoming the urging force of the urging means, the actuating member 12 abuts against the lower stopper 14, as shown in FIG. 1 (*b*). The position where the actuating member 12 abuts against the lower stopper 14, is a release position at which the actuating member 12 releases the engagement between the latch member and the tongue.

The actuating member 12 is formed thereon with a pair of first and second downward projected parts 12*a*, 12*b*, and further, a step part 12*c* is formed on the inside of the right side second projected part 12*b* at a predetermined position.

Further, within the buckle housing 11, an inertia member 15 for inhibiting the actuating member 12 from moving to the release position under inertia is disposed below the actuating housing 11. This inertia member 15 incorporates an upward extending movement inhibiting part 15*a*, a rightward extending spring retaining part 15*b*, an upward extending movement inhibiting part 15*b* and a pair of first and second holes 15*c*, 15*d* which are formed in the inertia member 15 at predetermined positions with the gravitational center G being positioned therebetween, in predetermined shapes, respectively.

The movement inhibiting part 15*a* is formed so as to be positioned between the pair of projected parts 12*a*, 12*b* on the actuating member 12, having a width which is set such that it is prevented from abutting against the step part 12*c* on the right side projected part 12*b* when the movement inhibiting part 15*a* faces upward as shown in FIGS. 1 (*a*) and (*b*). Accordingly, when the actuating member 12 is moved to the release position as shown in FIG. 1 (*b*), the forward end of the movement inhibiting part 15*a* can enter deeply inward between the pair of projected parts 12*a*, 12*b* without abutting against the step part 12*c* on the right side projected part 12*b*.

Incidentally, FIG. 1 (*a*) shows such a position that the forward end of the movement inhibiting part 15*a* has entered inward between the pair of projected parts 12*a*, 12*b* in a normal condition. However, in this normal condition, the forward end of the movement inhibiting part 15*a* may be positioned outside of the space between the pair of projected parts 12*a*, 12*b* (below the space in the figure). However, in order to surely perform the normal release operation of the actuating member 12, the movement inhibiting part 15*a* is provided, as shown in FIG. 1 (*a*).

Further, the first and second holes 15*c*, 15*d* are respectively fitted loosely therein with first and second support bosses 16, 17 secured to the housing 11, and a compressing spring 18 is disposed under compression between the spring retaining part 15*b* and the buckle housing 11. Accordingly, the inertia member 15 is normally urged counterclockwise by the resilient force of the compression spring 18. Further, in the normal condition as shown in FIG. 1 (*a*), the right side of the upper end of the first hole 15*c* abuts against the first boss 16 while the lower end of the second hole 15*d* abuts against the second boss 17. Accordingly, the inertia member 15 is inhibited from being further rotated counterclockwise, as well disabling the vertical movement of the inertia member 15. However, the inertia member 15 can be rotated clockwise when a clockwise movement is performed, overcoming the counterclockwise moment given by the resilient force of the spring 18. In this normal condition, the movement inhibiting part 15*a* faces up, as mentioned above.

Next, explanation will be made on the operation of the buckle device thus constructed.

In the normal condition, as shown in FIG. 1 (*a*), the actuating member 12 is held at tile unrelease position. Further, the movement inhibiting part 15*a* of the inertia member 15 is set upwardly to face up with the inertia member 15 being held at a position where the counterclockwise rotation and the vertical movement are inhibited. In this condition, the tongue and the latch member are engaged with each other in order to wear a seat belt.

In order to release the engagement between the tongue and the latch member, when the actuating member 12 is moved downward, the forward end of the movement inhibiting part 15*a* enters deeply inward between the pair of projected parts 12*a*, 12*b*, as shown in FIG. 1 (*b*), and accordingly, the actuating member 12 is set at the release position. Thus, the engagement between the tongue and the latch member is released.

Upon collision between vehicles or the like, when a pretensioner which is not shown is actuated so as to rapidly pull the buckle device 10 downward in the figure in order to fasten the seat belt, high acceleration acts downward upon the buckle device 10. When the downward acceleration is applied to the buckle device 10, large upward inertia forces acts upon the gravitational center (which is not shown) of the actuating member 12 and the gravitational center G of the inertia member 15. However, as shown in FIG. 2 (*a*), since the actuating member 12 abuts against the upper stopper 13, it never moves up, but is held at its initial position. Further, the large upward inertia force F1 acts upon the gravitational center G of the inertia member 15, and accordingly, a clockwise moment about the second support boss 17 caused by the inertia force F1 acts upon the inertia member 15. Accordingly, the inertia member 15 rotates clockwise about the second support boss 17, overcoming the resilient force of the compression spring 18, and the right corner part of the forward end of the movement inhibiting part 15*a* abuts against the side wall of the second projected part 12*b*. In this condition, the buckle device 10 is pulled further by the pretensioner by a predetermined distance so that it is moved as far as possible, and after completion of the movement of the buckle device 10, a large upward deceleration acts upon the buckle 10.

With this large acceleration, large downward inertia forces F2, F3 act upon the gravitational center of the actuating member 12 and the gravitational center G of the inertia member 15, respectively, as shown in FIG. 2 (*b*). The actuating member 12 is moved down toward the release position by these large inertia forces F2, F3, and the inertia member 15 is also moved down. As shown in this figure, due to the downward movement of the inertia member 15, the right corner part of the upper end of the first hole 15*c* abuts against the first support boss 16, and accordingly, the downward movement is inhibited from further moving. In this case, the inertia forces move the inertia member 15 until 15*c* abuts against support boss 16. During that time the support boss 17 has no influence on the movement of the inertia member 15. The inertia member 15 is inhibited from rotating counterclockwise so that the inertia member 15 is held at a position where the inertia member 15 can abuts against the step part 12*c* of the actuating member 12. The inertia member has now a tendency to rotate clockwise and even if it would not have been engaged completely, it would engage now completely.

Meanwhile, since the step part 12*c* abuts against the upper end surface of the movement inhibiting part 15*a* due to the downward movement of the actuating member 12, the inertia member 15 inhibits the actuating member 12 from moving downward further. Thus, the actuating member 12 never moves down to the release position. Accordingly, even though, due to the operation of the pretensioner, a large downward acceleration at first acts upon the buckle device 10, and thereafter, an upward deceleration acts thereto so as to act the large inertia force which can cause the actuating member 12 to move to the release position, it is possible to surely prevent the engagement between the tongue and the latch member from being released by the inertial movement of the actuating member 12.

Such a series of movements by the actuating device 10 is completed so that the large inertia forces acting upon the actuating member 12 and the inertia member 15 are eliminated, the actuating member 12 is moved upward to the initial unrelease position by an urging means which is not shown, and the inertia member 15 is moved upward and rotated counterclockwise by the compression spring 18 so as to be returned to its initial position. Thus, the buckle device 10 is held in the normal condition or at the neutral position as shown in FIG. 1 (*a*).

Thus, in the buckle device 10 according to the present invention, when the pretensioner is operated so that the buckle device 10 is abruptly pulled upon collision between the vehicles or the like, even though the actuating member 12 is moved, due to the inertia, in the direction in which the engagement between the tongue and the latch member is released, the movement of the actuating member 12 to the release position is surely inhibited, thereby it is possible to prevent the engagement between the tongue and the latch member from being erroneously released. Accordingly, even though the pretensioner is operated so as to abruptly pull the buckle device, the seat belt apparatus can fully exhibit its function, thereby it is possible to surely protect the passenger.

Figure 3B:
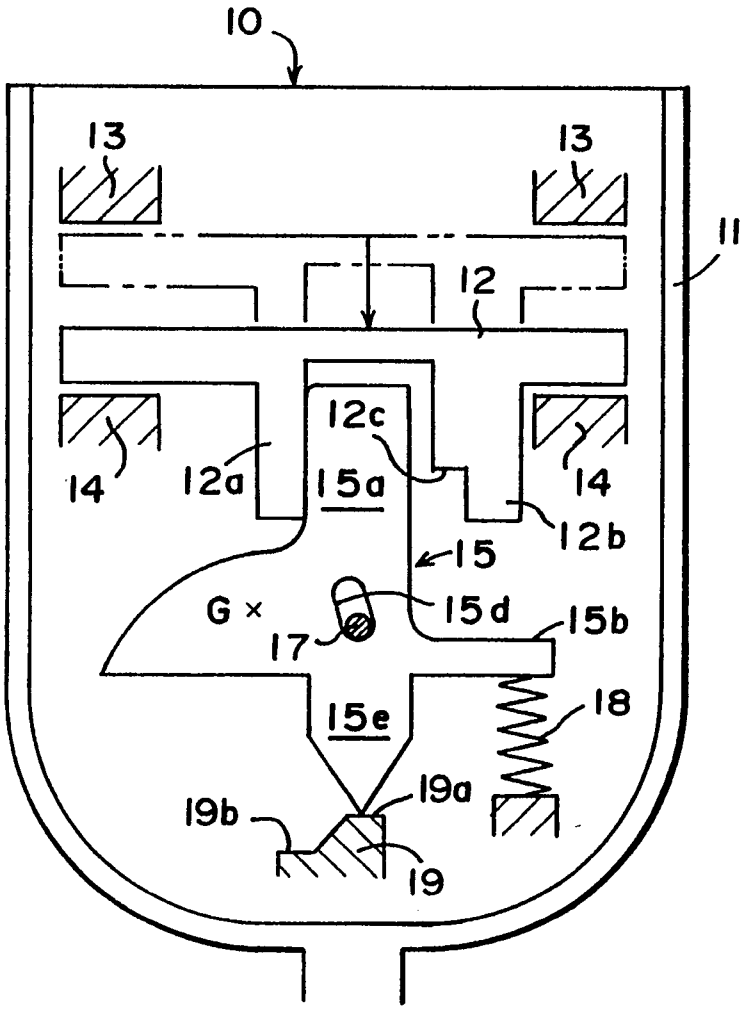
FIGS. 3(*a*) and 3(*b*) show another embodiment of the present invention similar to FIG. 1(*a*) and 1(*b*).
Figure 3A:
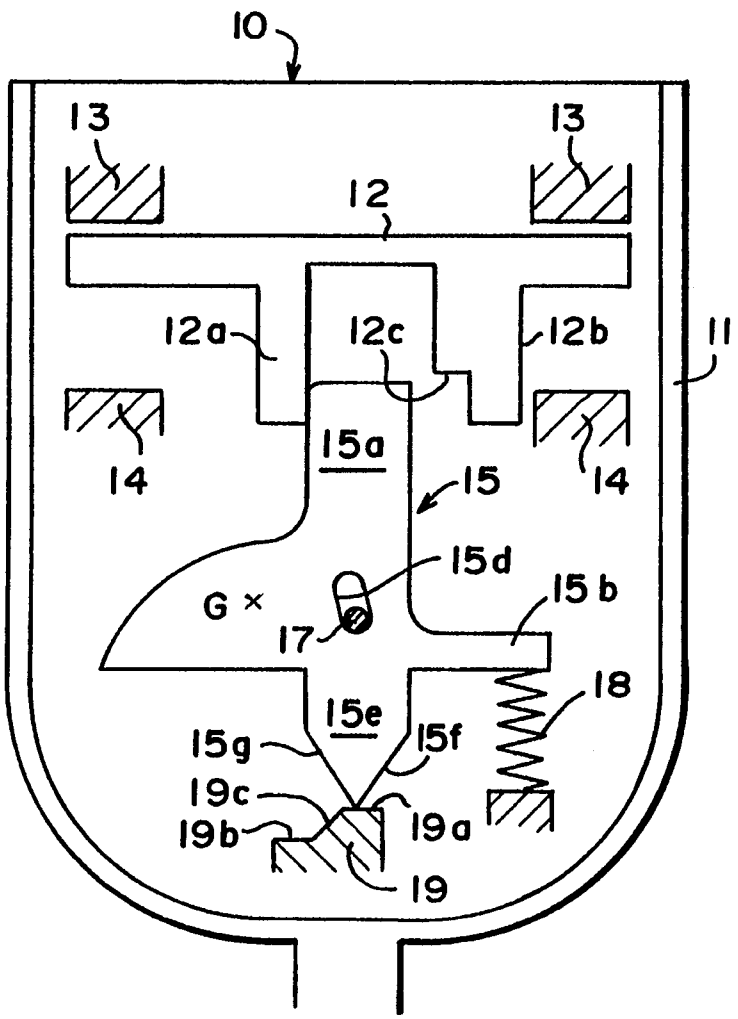
Figure 4B:
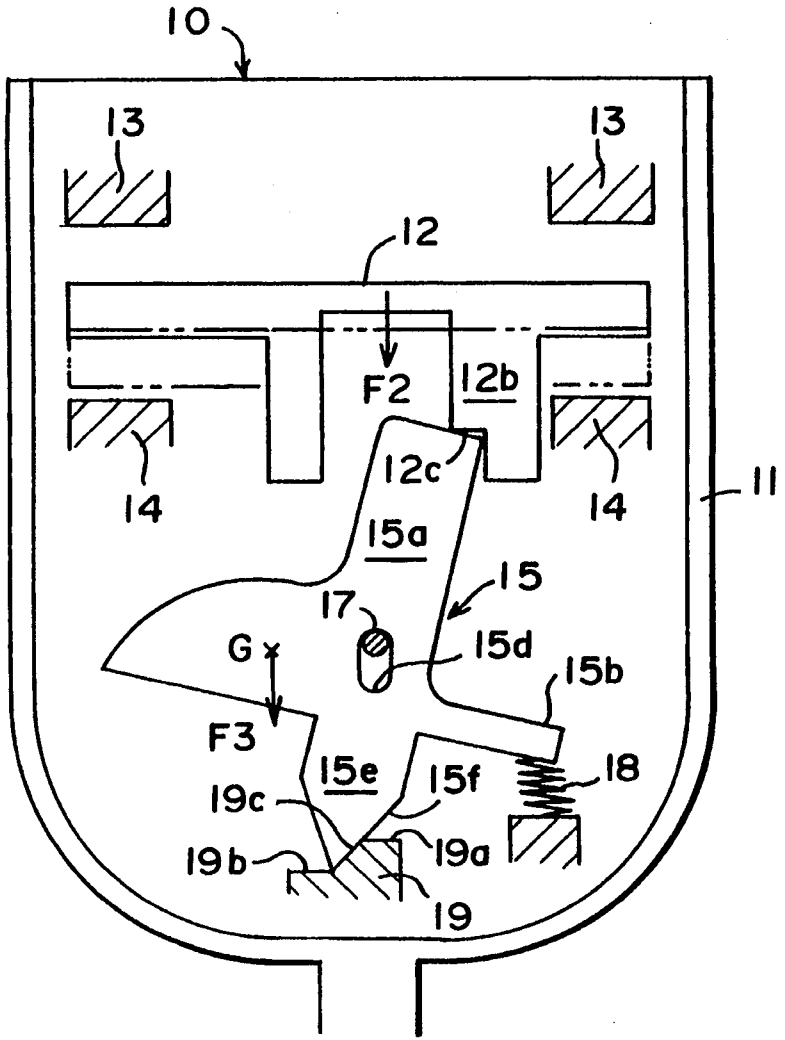
FIG. 4(*a*) and 4(*b*) show the embodiment, similar to FIG. 2(*a*) and 2(*b*)
Figure 4A:
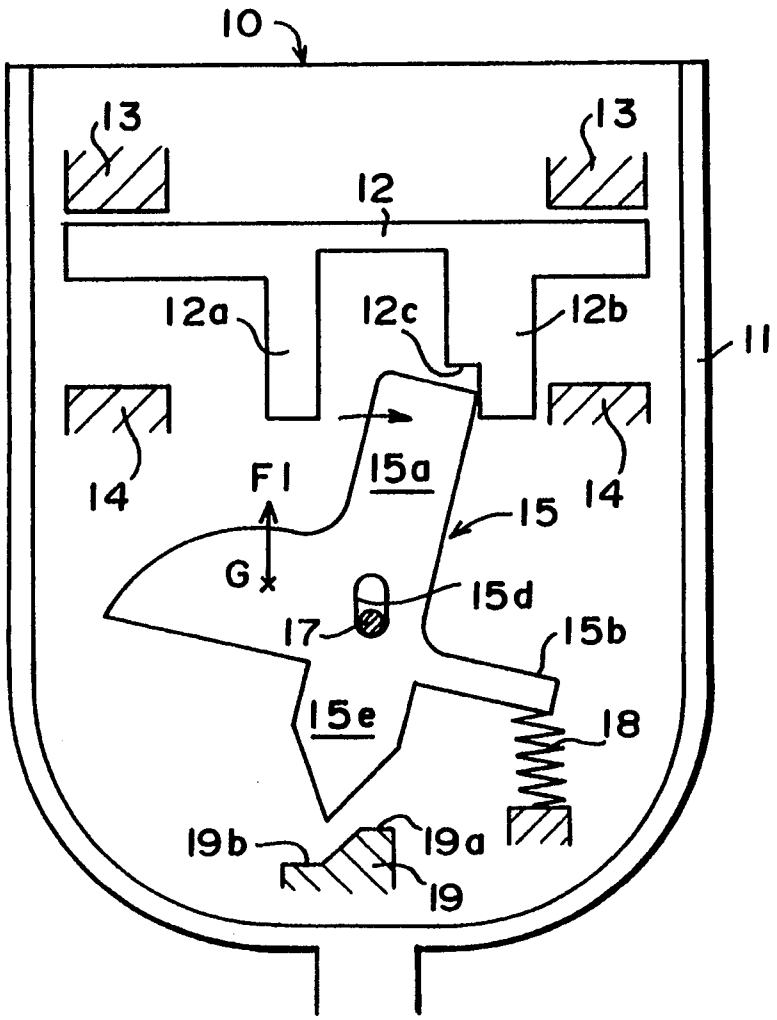

FIGS. 3 and 4 show another embodiment of the present invention, similar to FIGS. 1 and 2. It is noted that the same reference numerals are attached to components and elements similar to those in the above-mentioned embodiment, and accordingly, the detailed description thereto is eliminated.

In this embodiment, the first holes 15*c* and the first support boss 16 stated in the above-mentioned embodiment are eliminated, and further, the second hole 15*d* in which the second boss 17 is loosely fitted, is formed in an oval shape. This oval shape second hole 15*d* is formed so as to be inclined downward from the left side to the right side in the normal condition in which the movement inhibiting part 15*a* faces upward, and the inclination angle thereof is such that the oval shape second hole 15*d* is directed vertically when the right end of the forward end of the movement inhibiting part 15*a* abuts against the side surface of the second projected part 12*b* due to the clockwise rotation of the inertia member 15 as shown in FIG. 4 (*c*), that is, it is set to be equal to the possibly clockwise rotating angle of the inertial member.

Further, in this embodiment, a downward projected part 15*e* is formed on the inertia member 15, the lower end part of the downward projected part 15*e* is in an acute shape having inclined surfaces 15*f*, 15*g*. Further, the buckle housing 11 is provided therein with a rotation inhibiting member 19 which is located below the downward projected part 15*e*. The rotation inhibiting member 19 is formed thereon with first and second abutting surfaces 19*a*, 19*b* which are located at vertically different positions, and against which the lower end of the downward projected part 15*e* abut, and a step part between the first and second abutting surfaces 19*a*, 19*b* has an inclined surface 19*c*.

Further, in the normal condition as shown in FIG. 3 (*a*), the second boss 17 is positioned at the lower end of the second hole 17 so as to limit the upward movement of the inertia member 15, and further, the forward end of the downward projected part 15*e* abuts against the first abutting surface 19*a* so as to limit the downward movement of the inertia member 15. Further, either the vertical distance between the first and second abutting surfaces 19*a*, 19*b* is set to be slightly longer than the axial length of the second hole 17, or it is set to be substantially equal to the axial length of the second hole 17. Further, the inclination angle of the inclined surface 19*c* of the rotation inhibiting member 19 is set such that the inclined surface 19*c* becomes parallel with the inclined surface 15*f* of the forward end of the downward projected part 15*e* when the inertial member 15 is rotated so that the movement inhibiting part 15*a* abuts against the side surface of the second projected part 12*b*.

Further, in the present embodiment, the compression spring 18 causes counterclockwise movement, similar to the above-mentioned embodiment. In this case, the side surface of the moment inhibiting part 15*a* abuts against the side surface of the first projected part 12*a* of the actuating member 12, and accordingly, further counterclockwise rotation is inhibited.

Further, the gravitational center G of the inertia member 15 is set so as to be positioned on the side remote from the compression spring 18, with respect to the second support boss 17.

The buckle device 10 in this embodiment, is operated, similar to the above-mentioned embodiment. That is, the tongue and the latch member are engaged together in the normal condition as shown in FIG. 3 (*a*), but the engagement between this tongue and the latch member are released by moving the actuating member 12 downward toward the release position, as shown in FIG. 3 (*b*).

Further, an upward deceleration acts upon the buckle device 10 after a downward acceleration at first acts upon the buckle device 10, the actuating member 12 and the inertia member 15 take actions substantially similar to that of the above-mentioned embodiment, as shown in FIGS. 4 (*a*) and (*b*). In this case, an acceleration of a predetermined degree acts downward, the inertia member 15 is rotated clockwise about the second support boss 17 so that the forward end of the movement inhibiting part 15*a* thereof against the side surface of the second projected part 12*b*.

As best shown in FIG. 4 (*a*), in such a condition that the inertia member 15 is rotated as mentioned above, the forward end of the downward projected part 15*e* comes out from the first abutting surface 19*a*, and the second hole 15*d* is directed vertically so that the inertia member 15 can be easily moved.

In this condition, upon completion of the downward movement of the buckle device 10 caused by the downward acceleration, although a large upward deceleration acts upon the buckle device 10, this acceleration also causes the actuating member 12 and the inertia member 15 to move downward, substantially similar to the above-mentioned embodiment, as shown in FIG. 4 (*b*). Further, the forward end of the downward projected part 15*e* of the inertia member 15 abuts against the second abutting surface 19*b*, and the inclined surface 15*f* abuts against the inclined surface 19*c* of the rotation inhibiting member 19. Accordingly, the inertia member 15 is inhibited from further moving, and the counterclockwise rotation of the inertia member 15 is inhibited since the inclined surface 15*f* of the inertia member 15 abuts against the inclined surface 19*c* of the rotation inhibiting member 19 although the inertia member 15 tends to rotate counterclockwise by the inertia force F3 acting upon the inertia member 15 and the resilient force of the compression spring 18.

Meanwhile, the step part 12*c* of the second projected part 12*b* of the actuating member 12 abuts against the forward end of the movement inhibiting part 15*a* due to the downward movement of the actuating member 12, and accordingly, the actuating member 12 is inhibited from further downward moving, by means of the inertia member 15. Accordingly, the engagement between the tongue and the latch member is never released erroneously since the actuating member 12 never moves to the release position.

Figure 5B:
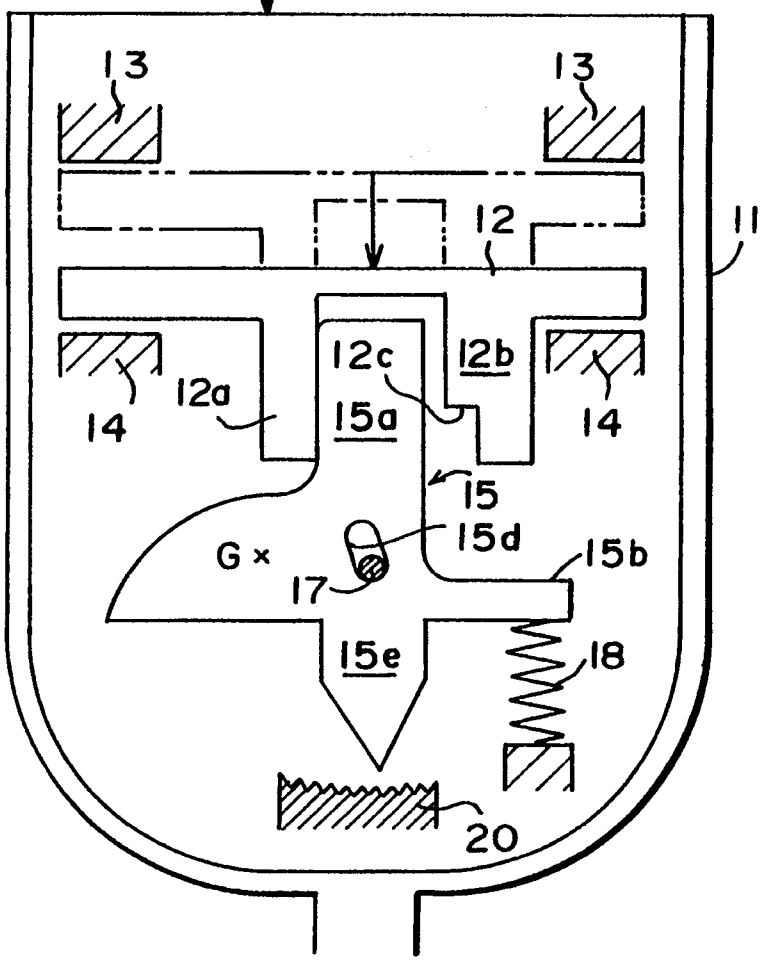
FIG. 5(*a*) and 5(*b*) shows a still another embodiment of the present invention similar to FIGS. 1(*a*) and 1(*b*).
Figure 5A:
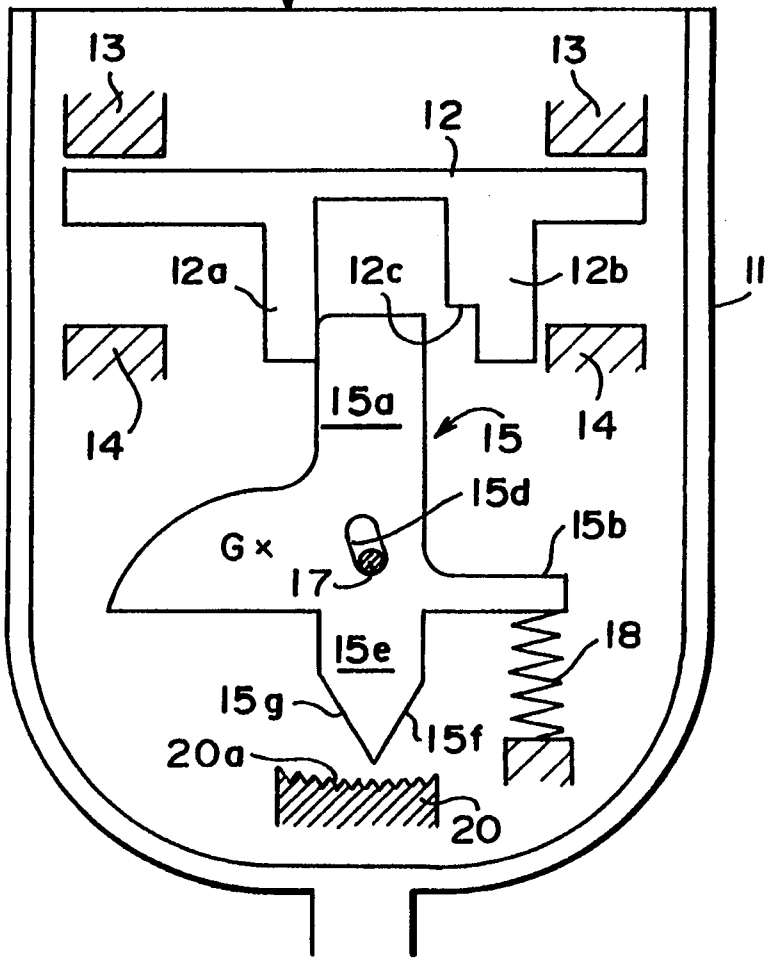
Figure 6B:
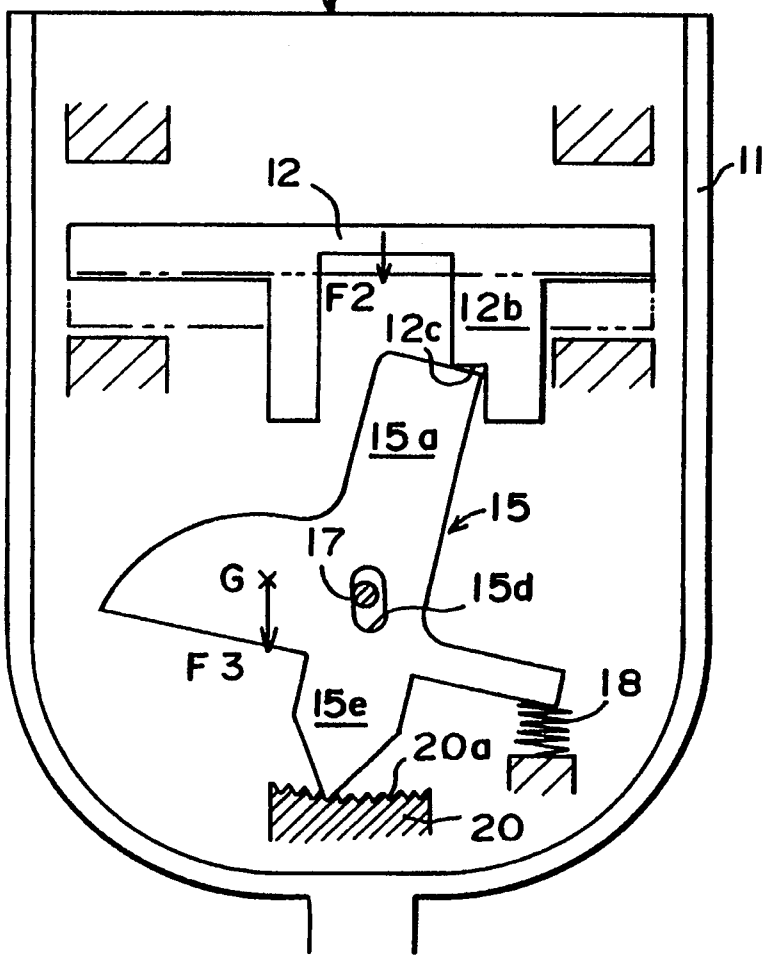
FIG. 6(*a*) and 6(*b*) shows the embodiment, similar to FIG. 2.
Figure 6A:
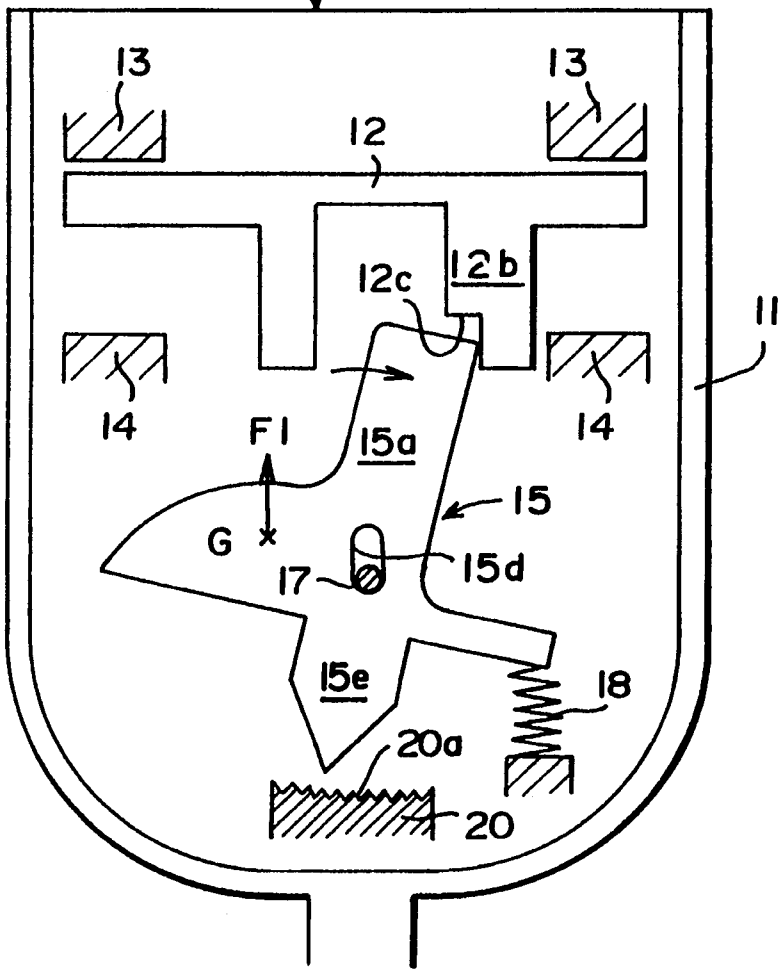

FIGS. 5 and 6 are a still another embodiment of the present invention, similar to FIGS. 3 and 4.

This embodiment differs from the one shown in the above-mentioned embodiment shown in FIGS. 3 and 4 in such a point that a rotation inhibiting member 20 is provided, in stead of the rotation inhibiting member 19, but other components are similar to those in the above-mentioned embodiment. As shown in FIGS. 5 and 6, this rotation inhibiting member 20 has a surface facing the downward projected part 15*e*, which is defined by an arcuate surface, and a predetermined number to teeth to which the acute end of the lower projected part 15*e* can engage, are formed on this arcuate surface. The arcuate surface is defined by a circle about the second support boss 17 as a center. Further, in the normal condition as shown in FIG. 5 (*a*), the inertia member 15 is slightly moved upward by the resilient force of the compression spring 18 so that the lower end of the second hole 15*d* abuts against the second support shaft 17, and further the acute end of the downward projected part 15*e* is separated from the teeth 20*e* by a predetermined degree.

The operation of this embodiment is also substantially the same as that of the above-mentioned embodiment, and accordingly, explanation will be made of the different points in the operation. That is, as shown in FIG. 6 (*b*), when an upward large deceleration acts upon the buckle device 10, the actuating member 12 and the inertia member 15 are moved downward as shown in FIG. 6*b*, as is similar to the above-mentioned embodiment. Further, the acute end of the downward projected part 15*e* of the inertia member 15 engages with the teeth 20*e*. Accordingly, the inertia member 15 is prevented from further moving downward. In this case, the engagement between the acute end of the downward projected part 15*e* and the teeth 20*e* on the arcuate surface inhibits the inertia member 15 from being rotated counterclockwise by the inertia force F3 and the resilient force of the compression spring 18.

Meanwhile, since the step part 12*c* on the second projected part 12*b* of the actuating member 12 abuts against the forward end of the movement inhibiting part 15*a* due to the downward movement thereof, further downward movement of the actuating member 12 is inhibited by means of the inertia member 15. Accordingly, the actuating member 12 does not move to the release position, thereby it is possible to erroneously prevent the tongue and the latch member from being released from each other.

Figure 7B:
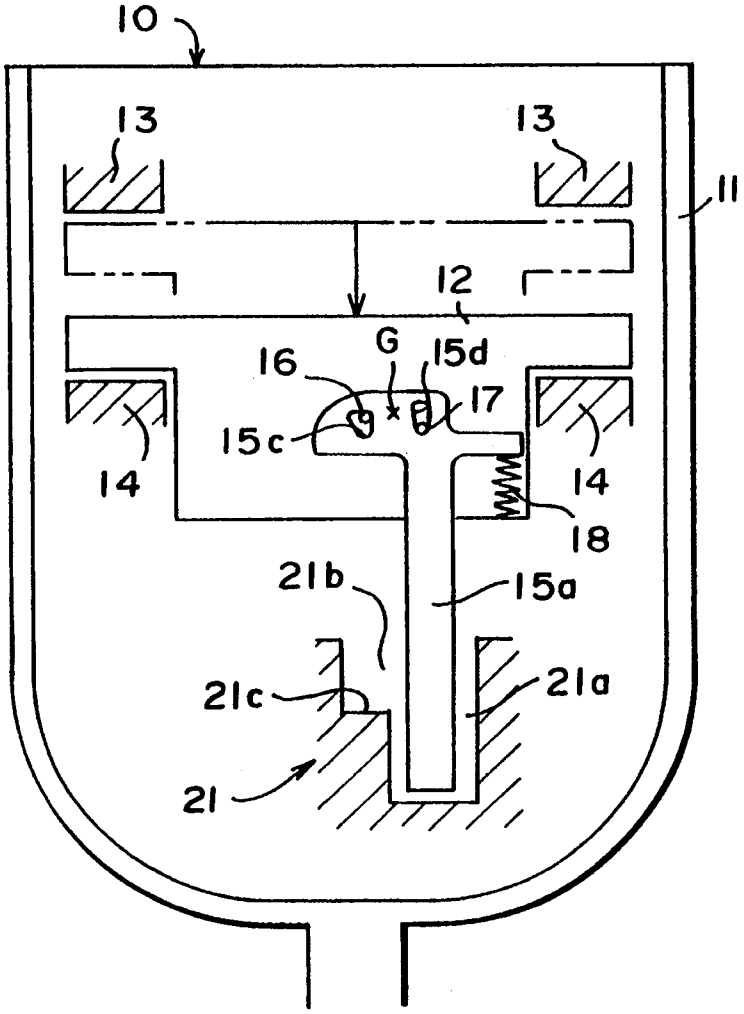
FIG. 7(*a*) and 7(*b*) shows a still another embodiment of the present invention, similar to FIG. 2(*a*) and 2(*b*).
Figure 7A:
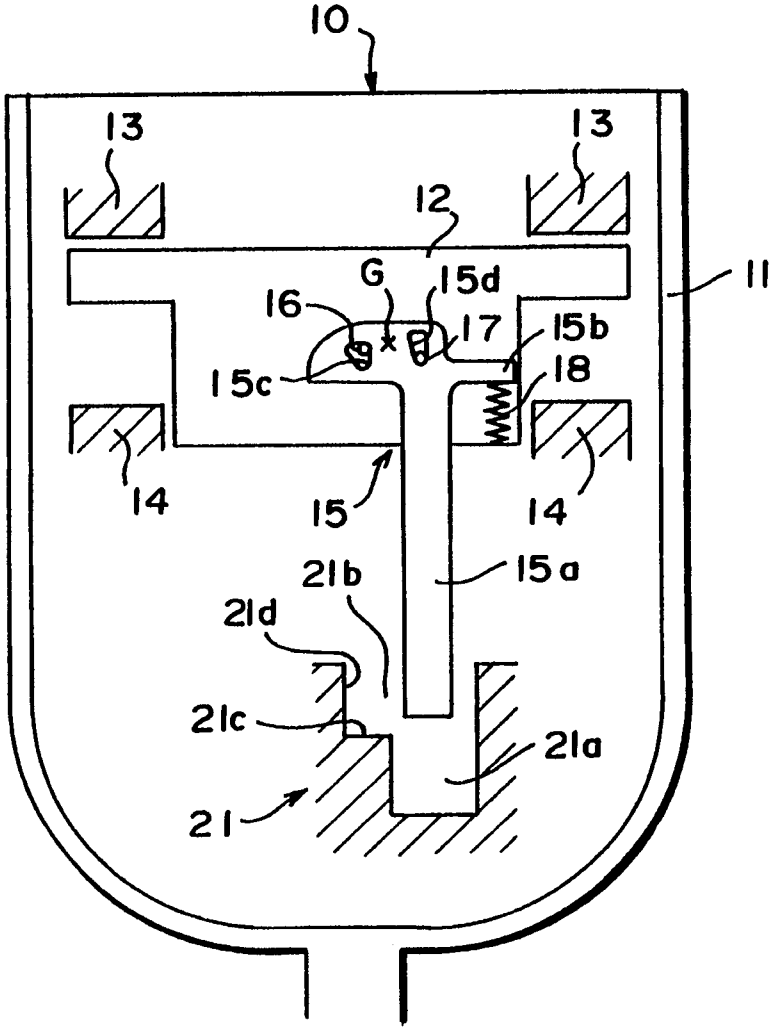
Figure 8B:
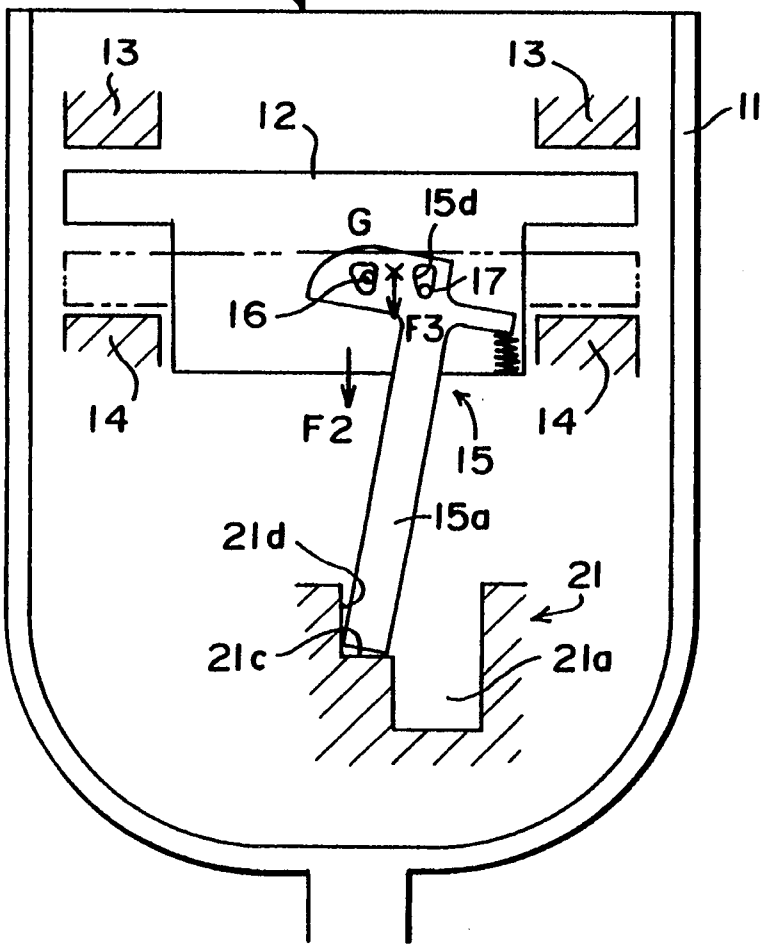
FIG. 8(*a*) and 8(*b*) shows the embodiment similar to FIG. 2(*a*) and 2(*b*).
Figure 8A:
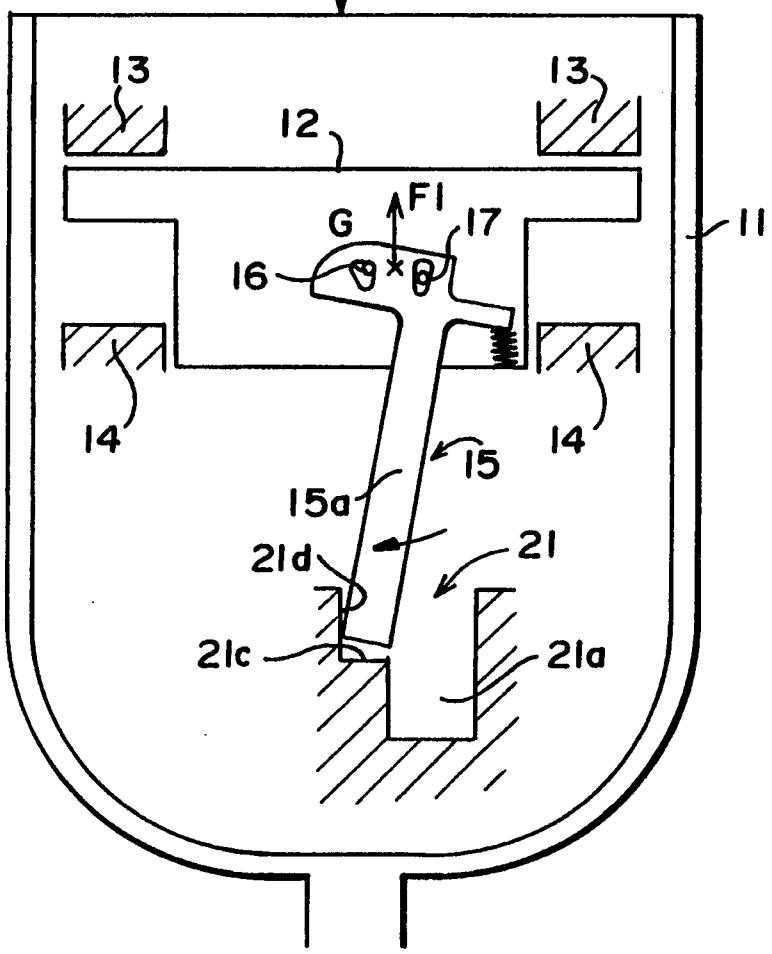

FIGS. 7 and 8 show a still another embodiment of the present invention, similar to FIGS. 1 and 2.

Although the inertia member 15 and the first and second support bosses 16, 17 are provided to the buckle housing 11 in the embodiment shown in FIGS. 1 and 2, the inertia member 15 and the first and second support bosses 16, 17 are provided to the actuating member 12.

Further, although the movement inhibiting part 15*a* of the inertia member 15 is formed being projected upward in the embodiment shown in FIGS. and 2, it is projected downward in the present embodiment. Further, the step part 12*c* for inhibiting the downward movement of the actuating member 12 to the release position, due to the engagement of the movement inhibiting part 15*a*, is formed on the stopper 21 provided to the buckle housing 11 in the present embodiment, instead of provision thereof on the actuating member 12. That is, as shown in FIG. 7 (*a*), the stopper 21 is composed of a relatively deep first fitting recess part 21*a* and a relatively shallow second recess part 21*b*. In this case, the bottom 21*c* of the second recess part 21*b* corresponds to the step part 12*c* in the above-mentioned embodiment, and the side wall 21*d* of the second recess part 21*b* corresponds to the side surface of the second projected part 12*b* of the second actuating member in the above-mentioned embodiment, against which the movement inhibiting part 15*a* abuts during clockwise rotation of the inertia member.

The operation of the buckle device in this embodiment, is also substantially the same as that of the buckle device shown in FIGS. 1 and 2, and the explanation thereof is omitted.

Thus, in any one of the above-mentioned embodiments, since the inertia member 15 engages with the actuating member 12, resisting the movement of the actuating member 12 to the release position when the buckle device 10 is pulled abruptly by the pretensioner upon collision between the vehicles or the like, the movement of the actuating member 12 to the release position is inhibited. Thereby it is possible to surely prevent the engagement between the tongue and the latch member in the buckle device 10 from being erroneously released.

Since the inertia member 15 simply rotates so as to engage with the actuating member 12 during the movement of the actuating member 12 in the releasing direction, and accordingly, the movement of the actuating member 12 is inhibited, it is not necessary to increase the mass of the inertia member 15 so greatly. Accordingly, the buckle device can be made to be lightweight and compact.

Further, since it is sufficient to simply combine the actuating member 12 and the inertial member 15, the structure thereof can be simplified, and the cost thereof can be reduced.

Further, since the inertia member 15 engages with the actuating member 2 only during the operation of the pretensioner, no affect is applied to the inertia member 15 during the normal release operation of the actuating member. Accordingly, not so large force is required during the operation of the actuating member 12, and accordingly, light manipulation touch can be obtained so that the manipulation feeling becomes satisfactory.

As clearly understood from the explanation stated above, with the buckle device in the seat belt apparatus, according to the present invention, the movement of the actuating member to the release position is surely inhibited even though the buckle between vehicles or the like. Thereby it is possible to surely prevent the engagement between the tongue and the latch member in the buckle device from being erroneous released.

Further, the inertia member is simply rotated so as to engage with the actuating member during the movement of the actuating member in the releasing direction, and accordingly, the movement of the actuating member is inhibited, it is not necessary to increase the mass of the inertia member, thereby it is possible to make the buckle device lightweight and compact.

Further, since it is sufficient to combine the actuating member and the inertia member with each other, no affect is applied to the inertia member, thereby the structure is simplified and the cost thereof is reduced.

Further, since no affect is applied to the inertia member during normal operation of the actuating member, not so large force is required during the operation of the actuating member, thereby it is possible to make the manipulation touch light, resulting in satisfactory manipulation feeling.

What is claimed is:

1. A buckle device in a seat belt device, which comprises an actuating member normally held at an unrelease position and adapted to be moved to a release position during manipulation, for releasing an engagement between a tongue and a latch member, and which is abruptly pulled by a predetermined distance by a pretensioner upon abrupt deceleration of a vehicle; and an inertia member disposed movably between an allowable movement position where said actuating member is allowed to move to said release position and a movement inhibiting position where the actuating member is inhibited from moving to said release position, and further, the inertia member is normally held at said allowable movement position, and is set so as to move said movement inhibiting position by inertia force upon operation of said pretensioner;

wherein said actuating member is contained in a housing while said inertia member is provided rotatably in said housing, and said inertia member further comprises a movement inhibiting part which is rotated to said movement inhibiting position so as to move to a position where it can engage with a stopper provided on said housing when an inertia force acts in a direction opposite to a moving direction in which said actuating member is moved to said release position in association with the operation of said pretensioner, whereby when the inertia force acts upon said inertia member in the direction opposite to the moving direction of said actuating member in association with the operation of said pretensioner, said movement inhibiting member is set at the position where said movement inhibiting part can engage with said stopper, and thereafter, when the inertia force acts upon said inertia member in the moving direction of said actuating member toward said release position, said actuating member is moved by the inertia force toward said release position so that said movement inhibiting member engages with said stopper, thereby the movement of said actuating member toward said release position is inhibited.

2. A buckle device in a seat belt device, which comprises a tongue engagable with a latch member, an actuating means for releasing an engagement between said tongue and said latch member, said actuating means having two projecting parts and normally held at an unrelease position and adapted to be moved to a release position during manipulation, and a pretensioner means for abruptly pulling said actuating means a predetermined distance upon abrupt deceleration of a vehicle; and an inertia means having a movement inhibiting part disposed movably between said two projecting parts of said actuating means in an allowable movement position for permitting movement in a first direction to said release position and in another direction to a movement inhibiting position, said movement inhibiting position inhibiting said actuating means from moving to said release position, said inertia means is normally held at said allowable movement position and is adapted to move in said another direction to said movement inhibiting position by inertia force upon operation of said pretensioner means.

3. A buckle device in a seat belt device as set forth in claim 2, wherein said inertia means is supported by boss means for permitting rotational and straight movement of said inertia means.

4. A buckle device in a seat belt device as set forth in claim 2, consisting of only one actuating means.

5. A buckle device in a seat belt device as set forth in claim 2, wherein said actuating means is contained in a housing and said inertia means is rotatably arranged in said housing, and said movement inhibiting part rotates to a position where said movement inhibiting part can engage said actuating means when said inertia force moves said inertia means in said another direction and thereafter relative movement of said actuating means toward said release position situates said inertia means in said movement inhibiting position by said movement inhibiting part engaging with said actuating means.

6. A buckle device in a seat belt device as set forth in claim 5, wherein one of said two projection parts of said actuating means is a stepped projection and said relative movement inhibiting part rotates to a position where said movement inhibiting part can abut a step of said stepped projection when said inertia force moves said inertia means in said another direction and thereafter relative movement of said actuating means toward said release position situates said inertia means in said movement inhibiting position by said movement inhibiting part abutting said step of said stepped projection.

7. A buckle device in a seat belt device as set forth in claim 5, wherein said inertia means is supported within said housing by boss means for permitting rotational and straight movement of said inertia means.

8. A buckle device in a seat belt device as set forth in claim 5, consisting of only one actuating means.

9. A buckle device in a seat belt device, which comprises a tongue engagable with a latch member, a housing containing a stopper and an actuating means for releasing an engagement between said tongue and said latch member, said stopper having an opening with first and second recesses, said actuating means normally held at an unrelease position and adapted to be moved to a release position during manipulation, and a pretensioner means for abruptly pulling said actuating means a predetermined distance upon abrupt deceleration of a vehicle; and an inertia means rotatably arranged within said housing and having a movement inhibiting part disposed movably within said opening of said stopper in an allowable movement position for permitting movement in a first direction to said release position where said movement inhibiting part is received in said first recess of said stopper and in another direction to a movement inhibiting position where said movement inhibiting means abuts said second recess of said stopper, said movement inhibiting position inhibiting said actuating means from moving to said release position; said inertia means is normally held at said allowable movement position and rotates to a position where said movement inhibiting part can abut said second recess of said stopper by inertia force upon operation of said pretensioner means and thereafter relative movement of said actuating means toward said release position situates said inertia means in said movement inhibiting position by said movement inhibiting part abutting said second recess of said stopper.

10. A buckle device in a seat belt device as set forth in claim 9, wherein said inertia means is arranged on said actuating means by boss means for permitting rotational and straight movement of said inertia means.

11. A buckle device in a seat belt device as set forth in claim 9, consisting of only one actuating means.

* * * * *